US008647157B2

(12) United States Patent
Gan et al.

(10) Patent No.: US 8,647,157 B2
(45) Date of Patent: Feb. 11, 2014

(54) MODULAR ELECTRICAL ASSEMBLY WITH JUMPER STORAGE

(75) Inventors: Mei Sing Gan, Singapore (SG); Chee Yeong Ya, Singapore (SG)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 13/324,128

(22) Filed: Dec. 13, 2011

(65) Prior Publication Data

US 2012/0149237 A1 Jun. 14, 2012

(30) Foreign Application Priority Data

Dec. 14, 2010 (SG) ..... 201009280-7

(51) Int. Cl.
*H01R 9/26* (2006.01)

(52) U.S. Cl.
USPC ..... 439/716; 439/507

(58) Field of Classification Search
USPC ..... 439/716, 507
See application file for complete search history.

(56) References Cited

U.S. PATENT DOCUMENTS

| | | | | |
|---|---|---|---|---|
| 5,669,788 | A * | 9/1997 | Brockman | 439/511 |
| 7,192,316 | B1 * | 3/2007 | Pollmann | 439/716 |
| 8,128,430 | B2 * | 3/2012 | Diessel | 439/507 |
| 2011/0014808 | A1 * | 1/2011 | Diessel | 439/296 |
| 2011/0059658 | A1 * | 3/2011 | Eisert et al. | 439/716 |
| 2012/0149237 | A1 * | 6/2012 | Gan et al. | 439/507 |
| 2012/0252262 | A1 * | 10/2012 | Reibke et al. | 439/507 |

FOREIGN PATENT DOCUMENTS

| | | | |
|---|---|---|---|
| CN | 101577399 | A | 11/2009 |
| DE | 29719177 | U1 | 1/1998 |
| DE | 29917825 | U1 | 2/2001 |
| DE | 102008014177 | A1 | 9/2009 |
| DE | 102008014179 | A1 | 9/2009 |
| FR | 2662549 | A1 | 11/1991 |
| WO | WO-2009112265 | A2 | 9/2009 |

OTHER PUBLICATIONS

Extended European Search Report dated May 17, 2013 in counterpart European Application No. EP11009723.5.
Office Action dated Nov. 15, 2013 issued by the People's Republic of China Patent Office in the corresponding Chinese patent application of U.S. Appl. No. 13/324,128.

* cited by examiner

*Primary Examiner* — Ross Gushi
(74) *Attorney, Agent, or Firm* — Frommer Lawrence & Haug LLP; David V. Rossi

(57) ABSTRACT

A modular electrical assembly adapted to be electrically connected to at least one other modular assembly by means of a connecting jumper. The assembly includes a storage structure for storing the connecting jumper associated with the assembly. A method of electrically connecting a modular electrical assembly to at least one other modular electrical assembly is also disclosed.

17 Claims, 5 Drawing Sheets

MODULAR ELECTRICAL ASSEMBLY WITH JUMPER STORAGE

CROSS-REFERENCE TO RELATED APPLICATIONS

This application is based upon and claims the benefit of priority from the corresponding Singapore Patent Application No. 201009280-7, filed Dec. 14, 2010, which is incorporated herein by reference in its entirety.

TECHNICAL FIELD

The present disclosure generally relates to a modular electrical assembly such as a relay, circuit breaker, residual current device (RCD) or other switch gear assembly that may be electrically connected to at least one other modular electrical assembly in use. More particularly, this disclosure relates to a modular electrical assembly and structure for storing a connecting jumper associated with the modular assembly.

BACKGROUND

Known electrical assemblies such as relays are typically connected via wires that are used as links between the relays. The process of installing relays using wires is time consuming and labor intensive. Also the quality of the connections may vary depending on the skill of the installer.

Known electrical assemblies are sometimes joined via jumper strips that must be purchased separately as an accessory. The jumper strips may have 20 or more contacts that typically have to be cut to suit an installation resulting in wastage of jumper strips and leaving an exposed cut metal edge that may give rise to safety concerns.

The present disclosure provides various embodiments of a modular electrical assembly and structure for storing a connecting jumper that may alleviate one or more of the above, or other, disadvantages of known electrical assemblies or that at least provides the consumer with a choice.

SUMMARY

According to an aspect of some embodiments of the present invention there is provided a modular electrical assembly adapted to be electrically connected to at least one other modular electrical assembly by means of a connecting jumper, wherein the assembly includes a storage structure for storing the connecting jumper associated with the modular assembly prior to use.

The modular assembly may include electrical switchgear such as a relay, relay socket, circuit breaker or residual current device (RCD).

The or each connecting jumper may include a generally U-shaped body made of a conducting material and may include two legs joined via a web. The conducting body may comprise a copper alloy or other material that has good electrical conductivity. The conducting web may be covered by an electrically insulated housing. The electrically insulated housing may comprise PBT (Polybutylene terephthalate) or PA66 (Polyamide or Nylon 66).

The storage structure may include one or more recesses in the assembly for retaining at least a part of the connecting jumper such as a leg. The or each recess may include an electrical contact or it may be a blank recess. The or each electrical contact may be adapted to be connectable to an electrical contact of at least one other modular assembly.

The storage structure may be adapted to store the connecting jumper in a front face of the assembly. The storage structure may be arranged in the front face of the assembly such that the web of the jumper extends substantially parallel to a long side of the front face. In some embodiments the storage structure may be arranged such that the web of the jumper extends at an angle relative to the long side of the front face.

In some embodiments, the front face of the assembly may include two recesses for receiving legs of a connecting jumper. The two recesses may be positioned along a line that extends substantially parallel to the front face of the assembly.

According to another aspect of some embodiments of the present invention there is provided a method of electrically connecting a modular electrical assembly to at least one other modular electrical assembly including connecting the assemblies by means of a connecting jumper, wherein the assembly includes a storage structure for storing said connecting jumper associated with the modular assembly prior to use.

It is understood that the foregoing summary is representative of some embodiments of the invention, and is neither representative nor inclusive of all subject matter and embodiments within the scope of the present invention. Additionally, it will be appreciated by those skilled in the art that the foregoing brief description and the following detailed description are exemplary and explanatory of some embodiments of the present invention, but are not intended to be restrictive of the present invention or limiting of the advantages which it can achieve in various implementations.

BRIEF DESCRIPTION OF THE DRAWINGS

Aspects, features, and advantages of some embodiments of the invention, both as to structure and operation, will be understood and will become more readily apparent when the invention is considered in the light of the following description made in conjunction with the accompanying drawings, in which like reference numerals designate the same or similar parts throughout the various figures, and wherein.

DETAILED DESCRIPTION

An illustrative embodiment of the present invention is described below with reference to slim body relay sockets being relay sockets that are approximately 6.2 mm wide. Nevertheless it will be appreciated that the present invention is also applicable to relay sockets and other modular electrical assemblies being other than slim body modular assemblies such as wide body relay sockets and wide body modular electrical assemblies.

Figure 2:
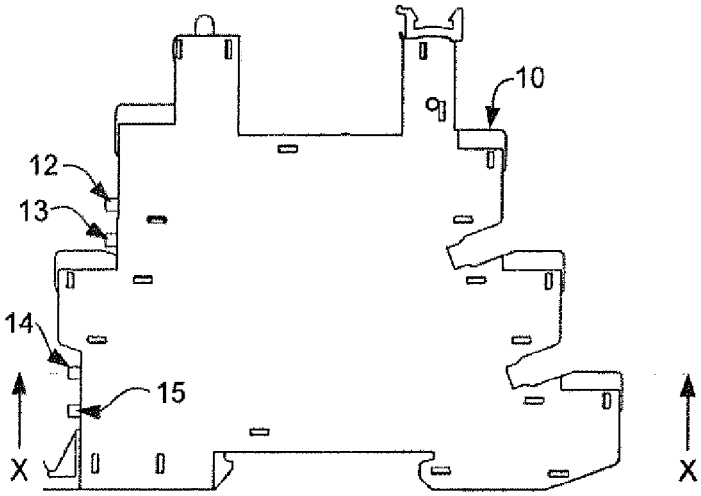
FIG. 2 shows a side view of the relay sockets in FIG. 1.
Figure 1:
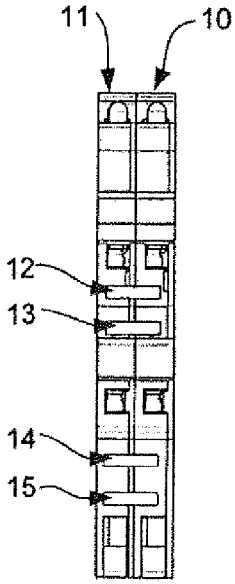
FIG. 1 shows a front view of a pair of relay sockets connected in use, in accordance with an embodiment of the present invention.

FIGS. 1 and 2 show front and side views of pair of relay sockets 10, 11, electrically joined together via jumpers 12-15 and FIGS. 3A-E show details of jumper 14 (jumpers 12, 13 and 15 may be substantially identical). A cross sectional view along line X-X in FIG. 2 is shown in FIG. 4 with detail 40 in FIG. 4 being shown in FIG. 5.

Referring firstly to FIGS. 3A to 3E, jumper 14 includes a U-shaped body 30 made of a conducting material such as copper alloy. Jumper body 30 includes legs 31, 32 joined via web portion 33. Web portion 33 is covered via a housing 34 made of an electrically insulating material such as plastics. Examples of suitable plastics for the insulating material include PBT (Polybutylene terephthalate) or PA66 (Polyamide or Nylon 66).

Jumper body 30 may be formed by stamping from a sheet of conducting material such as copper alloy sheet or it may be formed from copper alloy wire in any suitable manner and by any suitable means. Housing 34 may be formed over web portion 33 in any suitable manner and by any suitable means such as injection molding or the like.

Figure 3A:
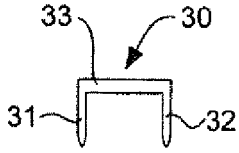
FIGS. 3A to 3E show views of a connecting jumper according to an embodiment of the present invention.
Figure 3B:
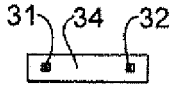
Figure 3C:
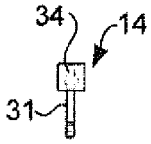
Figure 3D:
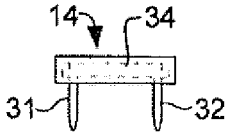
Figure 3E:
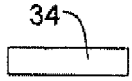
Figure 5:
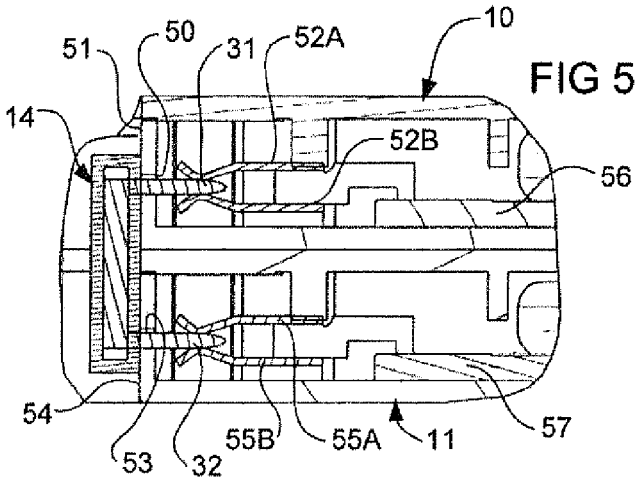
FIG. 5 shows detail 40 in FIG. 4.
Figure 4:
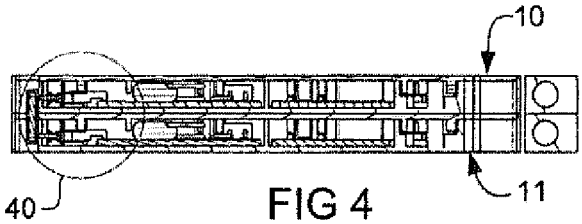
FIG. 4 shows a cross sectional view along X-X in FIG. 2.

Referring to FIGS. 4 and 5, leg 31 of jumper 14 is inserted in recess 50 in front face 51 of relay socket 10 and engages contacts 52A, 52B associated with relay socket 10. Leg 32 of jumper 14 is inserted in recess 53 in front face 54 of relay socket 11 and engages contacts 55A, 55B associated with relay socket 11. Jumper 14 is adapted to electrically connect contacts 52A, 52B associated with relay socket 10 with contacts 55A, 55B associated with relay socket 11. Contacts 52A, 52B are electrically connected to PCB 56 associated with relay socket 10 and contacts 55A, 55B are electrically connected to PCB 57 associated with relay socket 11. When jumper 14 engages contacts 52, 55 electrical communication may be facilitated between PCB 56 in relay socket 10 and PCB 57 in relay socket 11.

Jumper 15 performs a similar role to jumper 14 since its contacts (not shown) may be arranged to be electrically parallel with contacts 52, 55 respectively. One jumper of jumper pair 14, 15 may be electrically redundant when two relay sockets are electrically connected together as shown in FIG. 1. Similar comments apply to jumper pair 12, 13 wherein one jumper (12 or 13) may be electrically redundant when two relay sockets are electrically connected together as shown in FIG. 1. However jumper pair 12,13 or 14,15 and their associated contacts may not be electrically redundant when three or more relay sockets are electrically connected together as described below with reference to FIGS. 6-7.

Figure 6A:
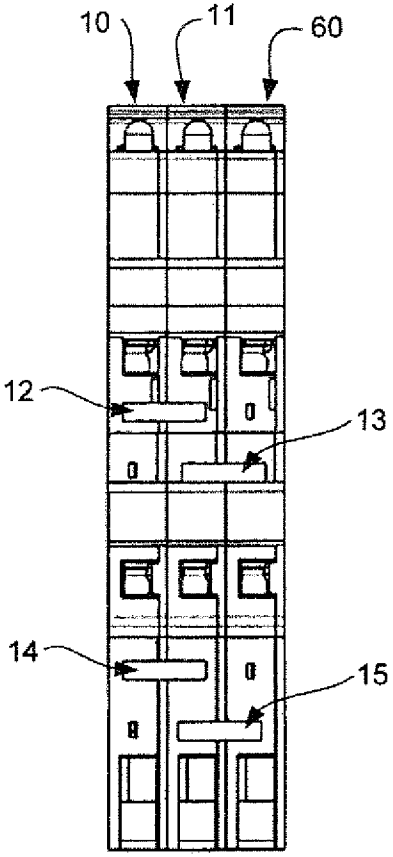
FIGS. 6A and 6B show front and perspective views of three relay sockets connected in use, in accordance with an embodiment of the present invention.
Figure 6B:
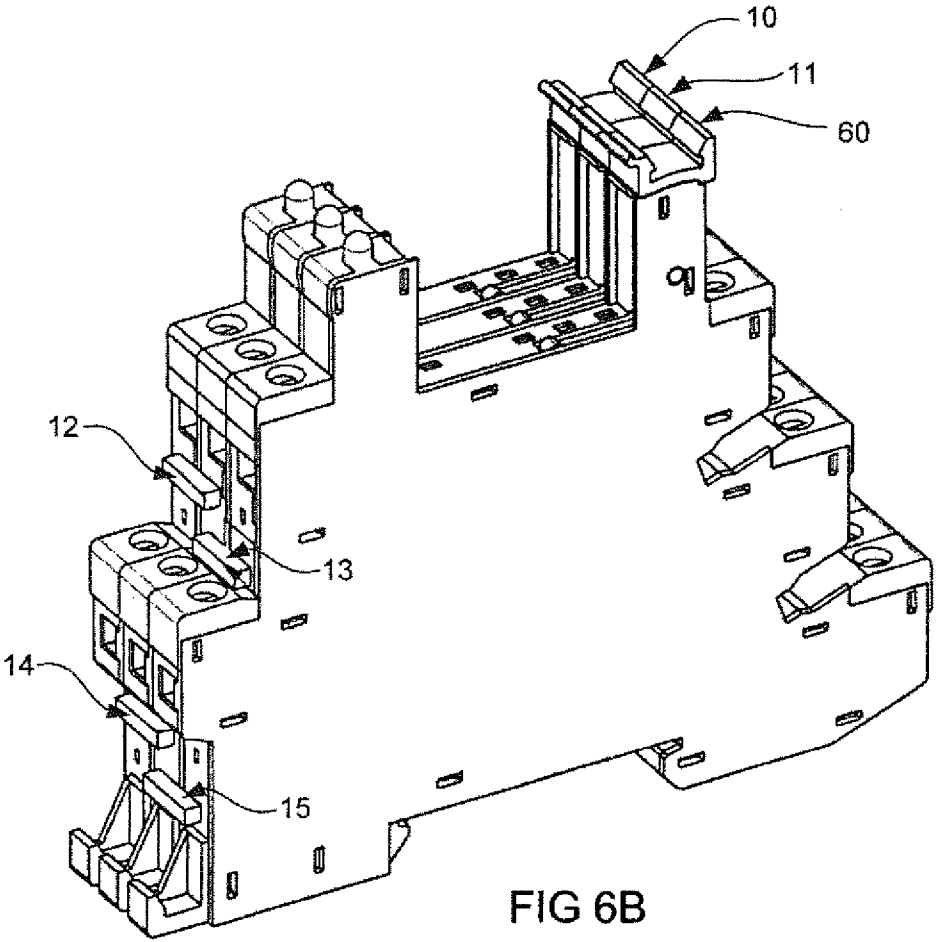

FIGS. 6A and 6B show front and perspective views of three relay sockets 10, 11, 60 electrically connected together via jumpers 12-15. However unlike FIG. 1 jumpers 12-15 are staggered such that jumpers 12, 14 connect relay sockets 10, 11 and jumpers 13, 15 connect relay sockets 11, 60. Also unlike FIG. 1 jumper pairs 12, 13 and 14, 15 respectively may not be electrically redundant notwithstanding that each jumper pair 12, 13 and 14, 15 may engage contacts that internally may be electrically parallel or connected together.

Figure 7A:
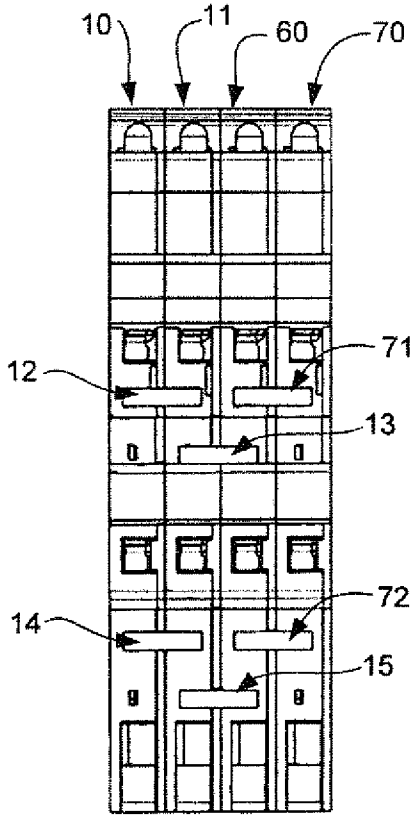
FIGS. 7A and 7B show front and perspective views of four relay sockets connected in use, in accordance with an embodiment of the present invention.
Figure 7B:
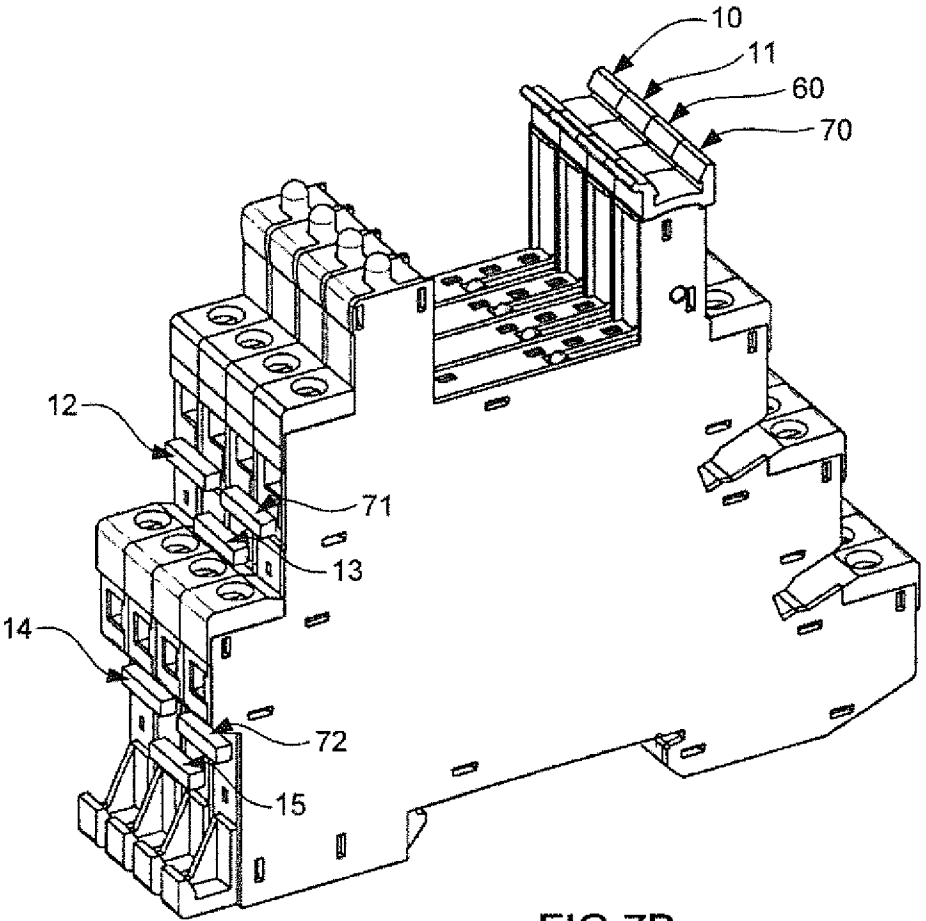

FIGS. 7A and 7B show front and perspective views of four relay sockets 10, 11, 60, 70 electrically joined together via jumpers 12-15, 71, 72. The jumpers are again staggered such that jumpers 12, 14 connect relay sockets 10, 11, jumpers 13, 15 connect relay sockets 11, 60 and jumpers 71, 72 connect relay sockets 60, 70. Jumper pairs 12, 13; 14, 15; 13, 71; 15, 72 also may not be electrically redundant notwithstanding that jumper triplets 12, 13, 71 and 14, 15, 72 may engage contacts that internally may be electrically parallel or connected together.

Figure 8:
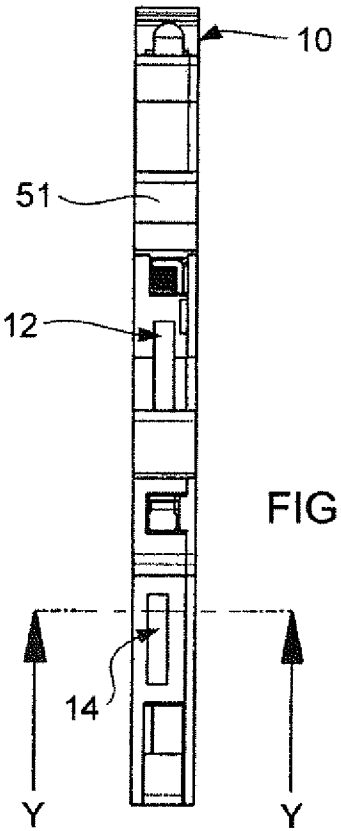
FIG. 8 shows a front view of a relay socket with jumpers in a storage position, in accordance with an embodiment of the present invention.
Figure 9:
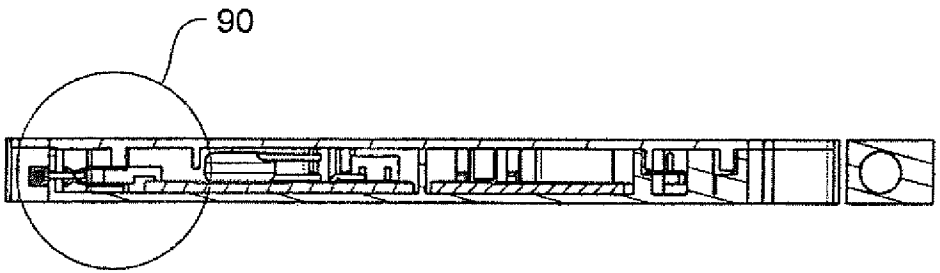
FIG. 9 shows a cross sectional view along line Y-Y in FIG. 8.

FIG. 8 shows the front face 51 of relay socket 10 with jumpers 12, 14 retained in relay socket 10 in a storage position. The legs of jumpers 12, 14 are retained in respective recesses formed in front face 51. A cross sectional view along line Y-Y in FIG. 8 is shown in FIG. 9 with detail 90 in FIG. 9 being shown in FIG. 10.

Figure 10:
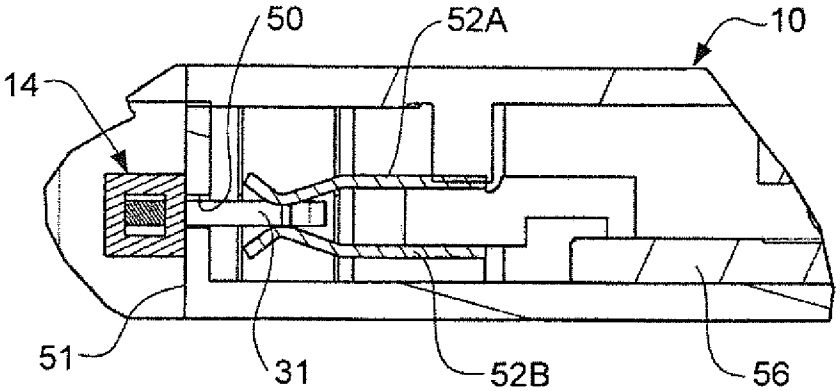
FIG. 10 shows detail 90 in FIG. 9.

FIG. 10 shows leg 31 of jumper 14 inserted in recess 50 in front face 51 of relay socket 10. Leg 31 is shown engaging contacts 52A, 52B although such contact may be electrically redundant in a storage position. Leg 32 of jumper 14 is inserted in a second recess (not shown) in relay socket 10. The second recess may be positioned along a line that extends substantially parallel to front face 51 of relay socket 10. In the storage position shown in FIG. 8 the second recess in relay socket 10 may be positioned substantially vertically below recess 50. Spacing between recess 50 and the second recess may be selected such that it is substantially the same as the spacing between legs 31, 32. The position of the second recess in relay socket 10 may correspond to a recess associated with jumper 15 shown in FIG. 1.

Figure 11:
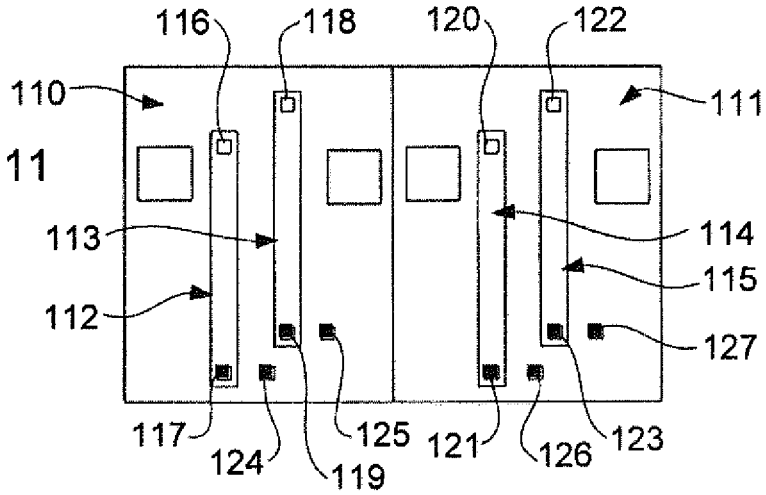
FIG. 11 shows a pair of wide body relay sockets before connection, in accordance with an embodiment of the present invention.

FIG. 11 shows wide body relay sockets 110, 111 positioned side by side prior to being electrically connected together via one or more connecting jumpers 112-115. Connecting jumpers 112-115 are shown in storage positions in association with relay sockets 110, 111. Each connecting jumper 112-115 may be similar in construction to connecting jumper 14 as described with reference to FIG. 3.

The legs of connecting jumper 112 are retained in recesses 116, 117 of relay socket 110 and the legs of connecting jumper 113 are retained in recesses 118, 119 of relay socket 110. The legs of connecting jumper 114 are retained in recesses 120, 121 of relay socket 111 and the legs of connecting jumper 115 are retained in recesses 122, 123 of relay socket 111.

Each recess 117, 119, 121, 123 and 124-127 includes an electrical contact while each recess 116, 118 120, 122 may be a blank recess that does not include an electrical contact. The electrical contacts (not shown) associated with recesses 119, 123, 125, 127 may comprise positive polarity contacts. The electrical contacts (not shown) associated with recesses 117, 121, 124, 126 may comprise negative polarity contacts.

Spacing between recess pairs 116, 117; 118, 119; 120, 121; and 122, 123 may be selected such that it is substantially the same as the spacing between legs 31,32 and/or recess pairs 123, 125 and 121, 124 when relay sockets 110,111 are positioned side by side.

Figure 12:
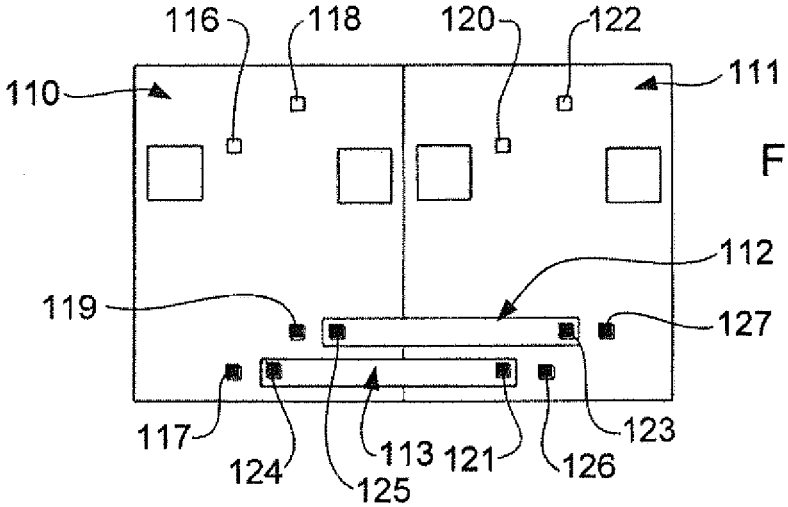
FIG. 12 shows a pair of wide body relay sockets after connection, in accordance with an embodiment of the present invention.
Figure 13:
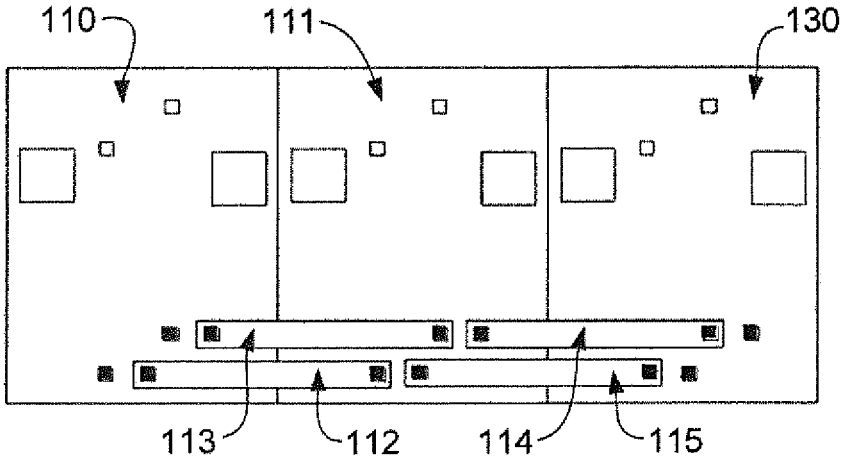
FIG. 13 shows three wide body relay sockets after connection, in accordance with an embodiment of the present invention.

FIG. 12 shows two wide body relay sockets 110, 111 electrically connected together via connecting jumpers 112, 113 and FIG. 13 shows three wide body relay sockets 110, 111, 130 electrically connected together via connecting jumpers 112-115.

Advantages of a modular electrical assembly including structure for storing a connecting jumper according to some embodiments of the present invention include:

1. Less inventory since jumpers required to connect one modular electrical assembly such as a relay socket to another modular electrical assembly may be stored and purchased with the modular assembly.
2. Even if end users pay for two additional jumpers with each modular assembly (which they may not use) the extra cost may be offset because purchase of long jumper strips which must be cut to length and associated wastage may be avoided.
3. The issue of exposed metal after a jumper strip is cut may be avoided leading to improved safety in the use of jumpers with an insulated housing according to some embodiments of the present invention.
4. Accurate and consistent interconnection between modular assemblies may be ensured promoting product reliability and improving safety.

It will be understood, however, that the present invention may be practiced without necessarily providing one or more of the advantages described herein or otherwise understood in view of the disclosure and/or that may be realized in some embodiments thereof. Additionally, it is to be understood that various alterations, modifications and/or additions may be introduced into the constructions and arrangements of parts previously described without departing from the spirit or scope of the present invention. It is therefore intended that the present invention is not limited to the disclosed embodiments but should be defined in accordance with the claims that follow.

What is claimed is:

1. A modular electrical assembly configured to be electrically connected to at least one other modular electrical assembly via a connecting jumper, wherein said assembly comprises: a storage structure configured to store said connecting jumper associated with said modular assembly prior to use of the connecting jumper to electrically connect said assembly to said at least one other assembly; and electrical switchgear.

2. The modular electrical assembly according to claim 1 wherein said electrical switchgear comprises at least one of a relay, a circuit breaker, and a residual current device (RCD).

3. The modular electrical assembly according to claim 1 wherein said connecting jumper comprises a generally U-shaped body made of a conducting material including two legs joined via a web, and wherein said web is covered by an electrically insulated housing.

4. The modular electrical assembly according to claim 3 wherein said conducting body comprises copper alloy.

5. The modular electrical assembly according to claim 3 wherein said storage structure is adapted to store said connecting jumper in a front face of said assembly such that said web extends substantially parallel to a long side of said front face.

6. The modular electrical assembly according to claim 3 wherein said storage structure includes two recesses in said assembly for receiving the legs of said connecting jumper.

7. The modular electrical assembly according to claim 6 wherein said two recesses are positioned along a line that extends substantially parallel to a front face of said assembly.

8. In combination the modular electrical assembly according to claim 1 and including at least one connecting jumper stored in association with said assembly prior to use.

9. A method of electrically connecting a modular electrical assembly to at least one other modular electrical assembly, the method comprising connecting said assemblies by using a connecting jumper, wherein said assembly includes a storage structure for storing said connecting jumper associated with said modular assembly prior to use of said connecting jumper to connect said assemblies, and wherein said modular assembly includes electrical switchgear.

10. The method according to claim 9 wherein said electrical switchgear comprises at least one of a relay, a circuit breaker, and a residual current device (RCD).

11. The method according to claim 9 wherein said connecting jumper comprises a generally U-shaped body made of a conducting material including two legs joined via a web, and wherein said web is covered by an electrically insulated housing.

12. The method according to claim 11 wherein said conducting body comprises copper alloy.

13. The method according to claim 11 wherein said storage structure is adapted to store said connecting jumper in a front face of said assembly such that said web extends substantially parallel to a long side of said front face.

14. The method according to claim 11 wherein said storage structure includes two recesses in said assembly for receiving respective legs of said connecting jumper.

15. The method according to claim 11 wherein said two recesses are positioned along a line that extends substantially parallel to a front face of said assembly.

16. A modular electrical assembly configured to be electrically connected to at least one other modular electrical assembly via a connecting jumper, wherein said assembly comprises a storage structure configured to store said connecting jumper associated with said modular assembly prior to use of the connecting jumper to electrically connect said assembly to said at least one other assembly, wherein said storage structure includes a recess in said assembly for retaining at least a part of said connecting jumper, and wherein said recess includes an electrical contact that is connectable to an electrical contact of said one other modular assembly.

17. A method of electrically connecting a modular electrical assembly to at least one other modular electrical assembly, the method comprising connecting said assemblies by using a connecting jumper, wherein said assembly includes a storage structure for storing said connecting jumper associated with said modular assembly prior to use of said connecting jumper to connect said assemblies, wherein said storage structure includes a recess in said assembly for retaining at least a part of said connecting jumper, and wherein said recess includes an electrical contact and including connecting said electrical contact to an electrical contact of said one other modular assembly by means of said connecting jumper.

* * * * *